US005301628A

United States Patent [19]

Daskalides

[11] Patent Number: 5,301,628

[45] Date of Patent: Apr. 12, 1994

[54] BOAT DOCKING POST

[76] Inventor: Georges B. Daskalides, 860 Sand Pine Dr. NE., St. Petersburg, Fla. 33703

[21] Appl. No.: 14,741

[22] Filed: Feb. 8, 1993

[51] Int. Cl.[5] ..... B63B 21/00

[52] U.S. Cl. ..... 114/230

[58] Field of Search ..... 114/230; 200/84 R; 441/1, 3, 133, 11

[56] References Cited

U.S. PATENT DOCUMENTS

| | | | |
|---|---|---|---|
| 1,768,446 | 6/1930 | Gron | 200/84 R |
| 1,775,020 | 9/1930 | Davin | 200/84 R |
| 2,680,859 | 6/1954 | Hultberg | 441/3 |
| 2,808,016 | 10/1957 | Jarnot | 114/230 |
| 3,060,885 | 10/1962 | Nolf | 114/230 |
| 3,177,839 | 4/1965 | Nolf | 114/230 |
| 5,014,638 | 5/1991 | Ilves et al. | 114/230 |

*Primary Examiner*—Sherman Basinger
*Attorney, Agent, or Firm*—Leon Gilden

[57] ABSTRACT

A docking post includes a tubular housing having a front wall, including an elongate slot directed through the front wall longitudinally aligned relative to the housing and parallel to the housing axis, with the housing having a rear wall mounted to an associated mooring post. A first tube is mounted within the housing, having a securement ring thereon, with a second tube positioned below the first tube having a length adjusted to accommodate a predetermined length between a boat water line and a boat securement cleat. A third buoyant tube is mounted below the second tube to effect displacement of the first and second tube relative to rising and lowering tides and water level relative to the tubular housing.

2 Claims, 4 Drawing Sheets

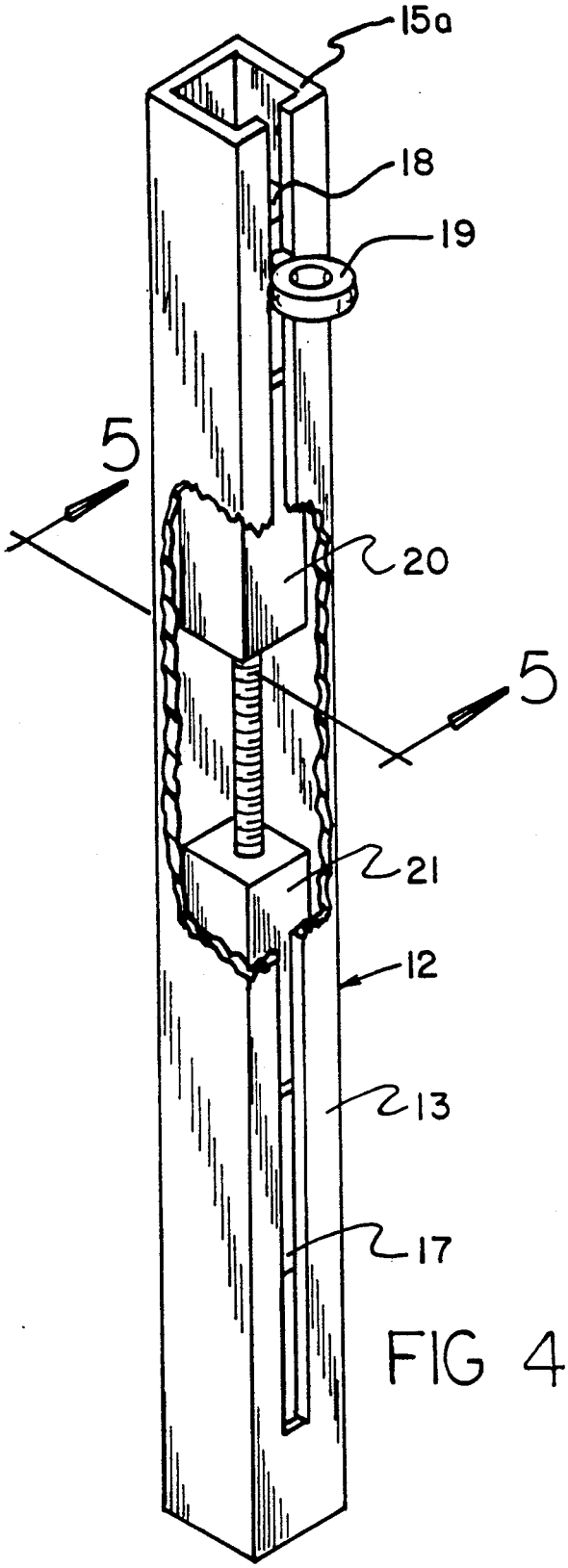
FIG 4
FIG 5
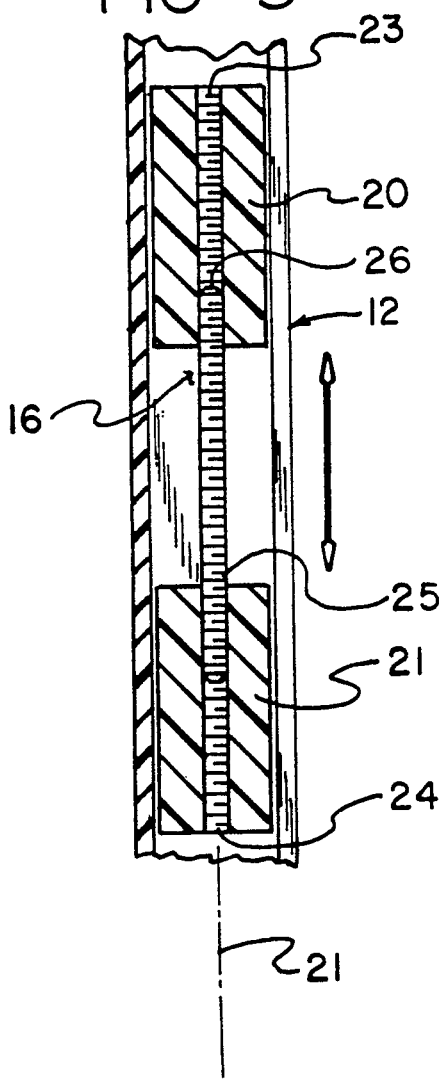

BOAT DOCKING POST

BACKGROUND OF THE INVENTION

1. Field of the Invention

The field of invention relates to boat docking apparatus, and more particularly pertains to a new and improved boat docking post wherein the same is arranged to accommodate water fluctuation relative to an associated boat member.

2. Description of the Prior Art

Docking systems of various types, such as indicated in U.S. Pat. Nos. 4,979,453 and 4,940,021 are available in the prior art relative to the docking of boats. The instant invention provides for the ease of mounting and securement of a docking post that accommodates rising and lowering tides relative to the post and in this respect, the present invention substantially fulfills this need.

SUMMARY OF THE INVENTION

In view of the foregoing disadvantages inherent in the known types of boat docking apparatus now present in the prior art, the present invention provides a boat docking post wherein the same is arranged to accommodate flotation of a mounting ring relative to a rising and lowering of a water level. As such, the general purpose of the present invention, which will be described subsequently in greater detail, is to provide a new and improved boat docking post which has all the advantages of the prior art boat docking apparatus and none of the disadvantages.

To attain this, the present invention provides a docking post including a tubular housing having a front wall, including an elongate slot directed through the front wall longitudinally aligned relative to the housing and parallel to the housing axis, with the housing having a rear wall mounted to an associated mooring post. A first tube is mounted within the housing, having a securement ring thereon, with a second tube positioned below the first tube having a length adjusted to accommodate a predetermined length between a boat water line and a boat securement cleat. A third buoyant tube is mounted below the second tube to effect displacement of the first and second tube relative to rising and lowering tides and water level relative to the tubular housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boat docking post which has all the advantages of the prior art boat docking apparatus and none of the disadvantages.

It is another object of the present invention to provide a new and improved boat docking post which may be easily and efficiently manufactured and marketed.

It is a further object of the present invention to provide a new and improved boat docking post which is of a durable and reliable construction.

An even further object of the present invention is to provide a new and improved boat docking post which is susceptible of a low cost of manufacture with regard to both materials and labor, and which accordingly is then susceptible of low prices of sale to the consuming public, thereby making such boat docking posts economically available to the buying public.

Still yet another object of the present invention is to provide a new and improved boat docking post which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an enlarged isometric view, partially in section, indicating a modified manner adjusting height adjustment between the second and third tubes within the housing.

FIG. 5 is an orthographic view, taken along the lines 5—5 of FIG. 4 in the direction indicated by the arrows.

DESCRIPTION OF THE PREFERRED EMBODIMENT

Figure 1:
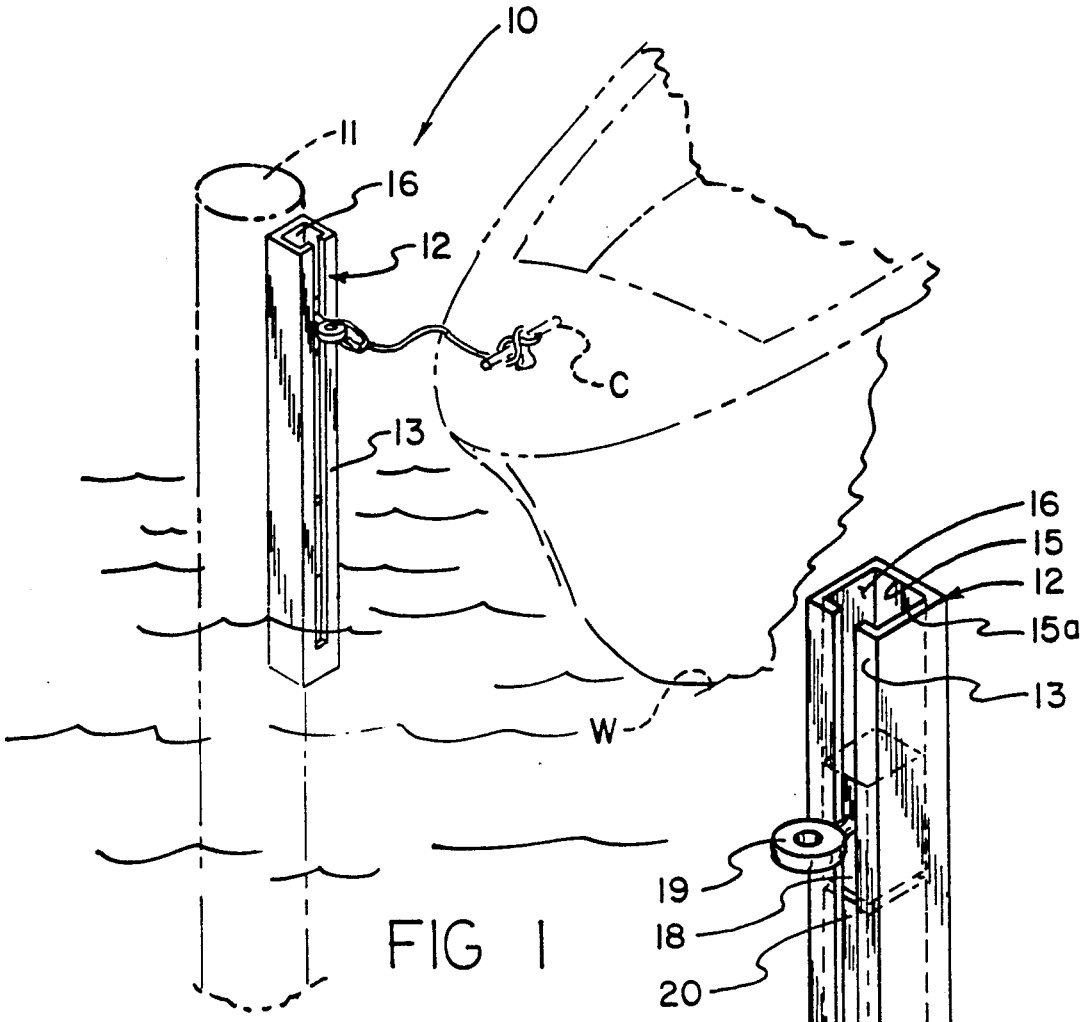
FIG. 1 is an isometric illustration of the invention in use.
Figure 2:
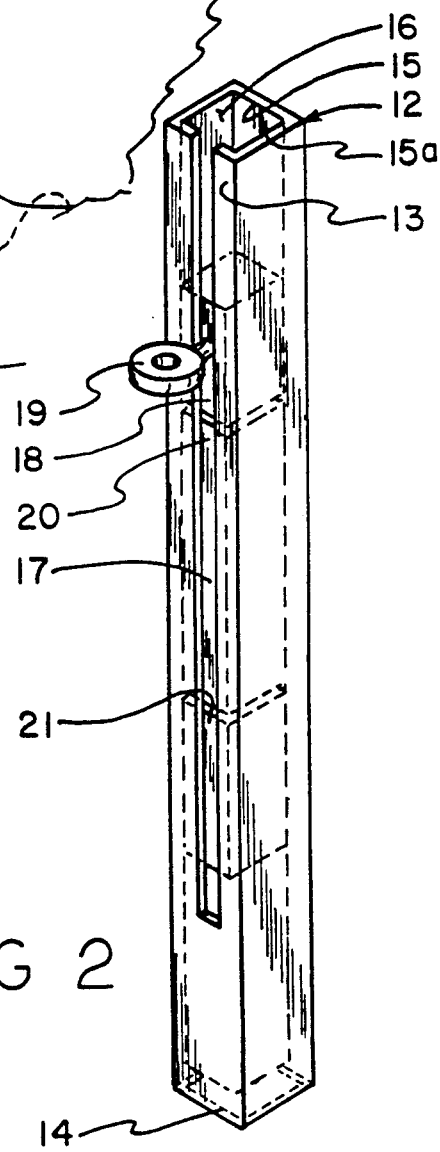
FIG. 2 is an enlarged isometric illustration of the housing structure of the invention.
Figure 3:
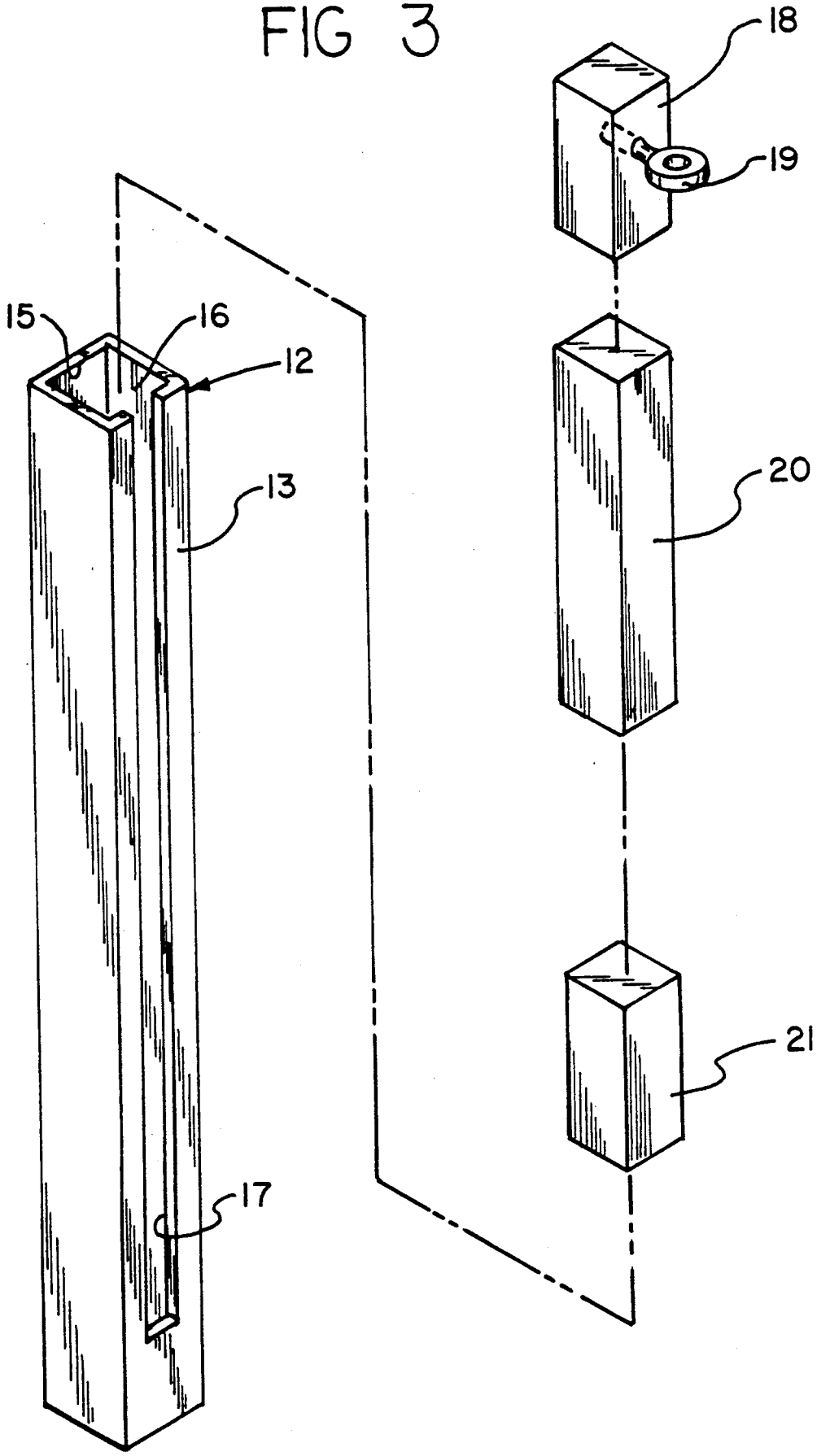
FIG. 3 is an isometric exploded view of the components of the invention.

With reference now to the drawings, and in particular to FIGS. 1 to 8 thereof, a new and improved boat docking post embodying the principles and concepts of the present invention and generally designated by the reference numeral 10 will be described.

More specifically, the boat docking post 10 of the instant invention essentially comprises mounting to a fixed mooring post 11 permitting securement of an associated boat thereto. Such boat is indicated in phantom in FIG. 1, with the boat having a water line "W" and a boat cleat "C" mounted to the deck of the boat, wherein typically the cleat is utilized as an anchoring position for a mooring rope to secure the boat relative to the mooring post.

The apparatus includes a tubular housing 12 longitudinally aligned about a predetermined axis 22 (see FIG. 5), wherein the housing includes a housing front wall 13 spaced from a housing rear wall, that in turn utilizes conventional fasteners to secure the housing relative to the mooring post 11. The housing includes a floor plate 14, with an entrance opening 15 directed into an associated elongate cavity 16 longitudinally aligned relative to the housing 12 along the axis 22, with the entrance opening 15 directed into the cavity 16 from a housing uppermost end 15*a*. A front wall slot 17 is directed from the housing uppermost end 15*a* to a spaced relationship relative to the housing floor plate 14. Within the elongate cavity 16 is slidably mounted a first tube 18 complementarily and slidably received within the elongate cavity, having a securement ring 19 projecting through the front wall slot 17 and beyond the housing front wall 13 for receiving the mooring rope thereto. A second tube 20 is arranged for severing to a predetermined length substantially equal to a predetermined height directed from the water line "W" to the boat cleat "C". A third buoyant tube 21 is positioned below the second tube 20 to effect raising and lowering of the first and second tubes 18 and 20. In this manner, the securement ring 19 is raised and lowered relative to the water surface positioning the securement ring 19 relative to and in horizontal alignment relative to the boat cleat "C".

The apparatus as indicated includes the second tube 20 having a second tube threaded bore 23, with the third tube having a third tube threaded bore 24, with each of the bores 23 and 24 coaxially aligned along the housing axis 22. A threaded adjustment rod 25 is threadedly received within the second and third threaded bores 23 and 24, with the rod 25 coaxially aligned along the threaded axis. To this end, the internally threaded second bore 23 is typically of a reverse thread relative to the third threaded bore 24 to permit selective displacement towards and away of the second tube relative to the third tube. The adjustor rod 25 is arranged to include an engaging portion 26 at an uppermost end thereof for receiving a tool fastener to permit ease of rotation of the rod 25 and adjustment of the third tube relative to the second tube and to in this manner provide for the selective height adjustment of the third tube relative to the second tube to accommodate a variety of boats having predetermined heights of varying dimensions from the water line "W" to the boat cleat "C".

Figure 6:
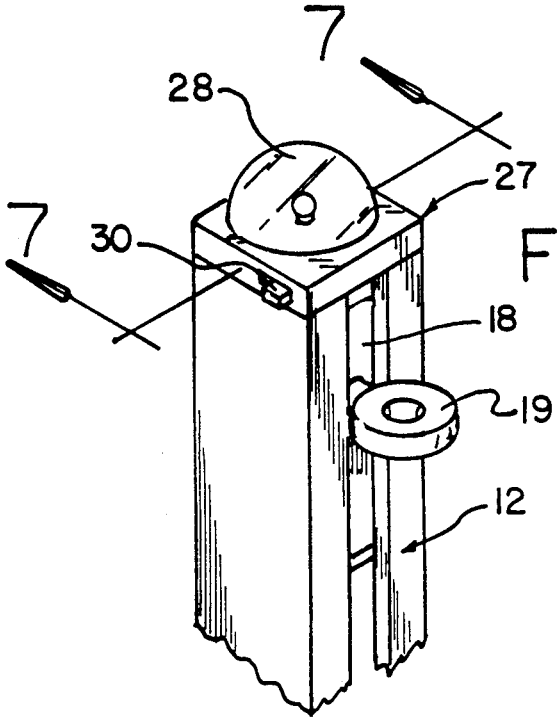
FIG. 6 is an isometric illustration of the invention including an alarm housing.
Figure 7:
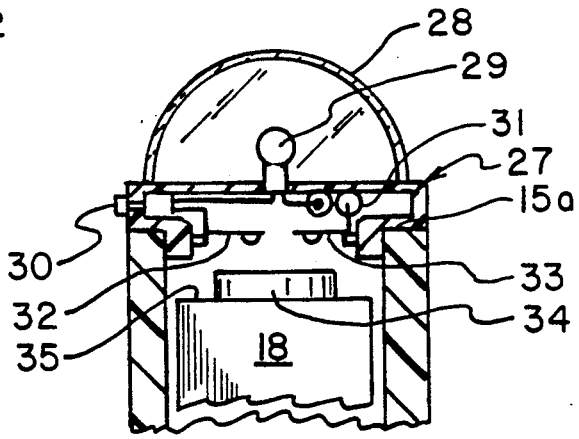
FIG. 7 is an orthographic view, taken along the lines 7—7 of FIG. 6 in the direction indicated by the arrows.
Figure 8:
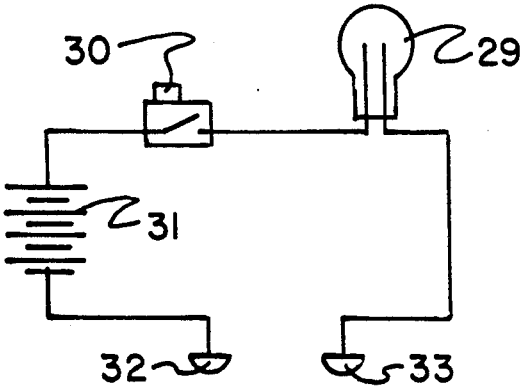
FIG. 8 is a diagrammatic electrical illustration of the invention relative to the alarm housing of FIGS. 6 and 7.

The FIGS. 6–8 indicate the use of an alarm housing 27 mounted to the housing uppermost end 15*a* in a frictionally secured relationship, with the alarm housing including a transparent lens 28 having an illumination bulb 29 contained therewithin. An on/off switch 30 is provided in electrical communication with the illumination bulb 29 through a battery 31. First and second contact lugs 32 and 33 are projected into the entrance opening 15, with the first tube having a first tube top wall 35 mounting an electrical conductive head member 34, whereupon engagement of the head member 34 with the first and second contact lugs 32 and 33 simultaneously, illumination of the bulb 29 is effected to thereby indicate that the tubular housing 12 to be raised in order to prevent displacement of the first tube relative to the cavity 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A boat docking post for securement to a mooring post, wherein the docking post comprises, a tubular housing, the tubular housing including a housing rear wall arranged for securement to the mooring post, and a housing front wall, with the housing including a housing floor plate at a first distal end of the housing, and a housing entrance opening directed into the housing from an uppermost end of the housing, with the uppermost end oriented at a second distal end of the housing, and the housing having an elongate longitudinally aligned cavity directed into the housing from the entrance opening, where the housing is symmetrically oriented about a housing axis, and the housing having a front wall slot directed through the front wall extending from the uppermost end in a spaced relationship relative to the floor plate, and a first tube complementarily and slidably received within the cavity, wherein the first tube includes a securement ring, the securement ring extending from the first tube through the front wall and projecting beyond the housing front wall, and a second tube positioned in adjacency to the first tube below the first tube, and a third tube positioned below the second tube in adjacency to the second tube, and the second tube is positioned intermediate the first tube and the third tube, and the third tube is buoyant to permit raising and lowering simultaneously of the first tube and the second tube with the third tube, and the second tube includes a second tube internally threaded bore, the third tube having a third tube internally threaded bore, and an externally threaded adjuster rod directed rotatably from the second tube threaded bore and the third tube threaded bore, wherein the second tube threaded bore and the third tube threaded bore are of reverse hand threading relative to one another, with the threaded adjustor rod threadedly received within the second threaded bore and the third threaded bore to permit selective adjustment of the second tube relative to the third tube.

2. A docking post as set forth in claim 1 including an alarm housing mounted to the tubular housing at the tubular housing uppermost end, the alarm housing including a transparent lens, and an illumination bulb mounted within the transparent lens, the housing further including an on/off switch and a battery, and a first contact lug and a second contact lug in electrical communication with the illumination bulb through the battery and the on/off switch, wherein the first contact lug and the second contact lug are positioned within the entrance opening in an aligned relationship orthogonally oriented relative to the axis, and the first tube having a first tube top wall, with the first tube top wall including an electrically conductive head member arranged for engagement with the first contact lug and the second contact lug to effect illumination of the illumination bulb.

* * * * *